United States Patent [19]

Funakoshi et al.

[11] Patent Number: 4,654,693

[45] Date of Patent: Mar. 31, 1987

[54] ELECTRONIC PARTS CARRIER WITH A CHIP-SUPPORTING TOP TAPE

[75] Inventors: Yasutomo Funakoshi; Masamitu Miyazaki; Tadashi Sakairi; Kozo Suzuki, all of Osaka, Japan

[73] Assignee: Matsushita Electric Industrial Co., Ltd., Japan

[21] Appl. No.: 769,769

[22] Filed: Aug. 27, 1985

[30] Foreign Application Priority Data

Aug. 28, 1984 [JP] Japan ..... 59-179728
Nov. 20, 1984 [JP] Japan ..... 59-245185

[51] Int. Cl.[4] ..... H01L 23/02; H01L 23/04; H01L 23/08

[52] U.S. Cl. ..... 357/74; 357/72; 357/68; 174/52 FP

[58] Field of Search ..... 357/74, 72, 84, 73, 357/68; 174/52 FP

[56] References Cited

U.S. PATENT DOCUMENTS

| | | | |
|---|---|---|---|
| 3,656,183 | 4/1972 | Walterscheid | 174/52 FP |
| 3,676,569 | 7/1972 | Thompson | 357/74 |
| 3,823,350 | 7/1974 | Stoner | 174/52 FP |
| 3,909,838 | 9/1975 | Beyerlein | 357/70 |
| 4,126,758 | 11/1978 | Krumme | 357/74 |
| 4,195,193 | 3/1980 | Grabbe et al. | 357/74 |
| 4,222,516 | 9/1980 | Badet et al. | 357/72 |
| 4,293,768 | 10/1981 | Adachi et al. | 357/72 |
| 4,552,267 | 11/1985 | Layher | 357/74 |

FOREIGN PATENT DOCUMENTS

| | | | |
|---|---|---|---|
| 0002284 | 1/1977 | Japan | 357/84 |
| 0153355 | 11/1980 | Japan | 357/84 |

*Primary Examiner*—Andrew J. James
*Assistant Examiner*—S. V. Clark
*Attorney, Agent, or Firm*—Lowe, Price, LeBlanc, Becker & Shur

[57] ABSTRACT

In an electronic parts carrier of the type comprising a bottom tape and a top tape for use with a chip-mounting machine, the top tape is arranged to be secured to the bottom tape so as to hold and sandwich each electronic parts chip between the lower surface of the top tape and a bottom of each recess made by the bottom tape. In one embodiment, the top tape is secured to the bottom tape by way of an adhesive where the depth of the recess is made slightly smaller than the height of the chips to be contained in the recess. In another embodiment, grooves are made in side walls of each recess so that convex portions made by the top tape are engageable with the grooves to secure the top tape with each electronic parts chip being held and sandwiched between the top tape and the bottom of each recess. A through-hole may be made in the bottom of the recess for easy recognition of the contained chips and for easy pushing up of the same when the chips are to be taken out of the carrier.

15 Claims, 7 Drawing Figures

ELECTRONIC PARTS CARRIER WITH A CHIP-SUPPORTING TOP TAPE

BACKGROUND OF THE INVENTION

This invention relates generally to electronic parts carriers used with a parts-mounting machine, and more particularly to such parts carriers or containers for integrated circuits with a so-called quad in-line package where leads are formed in four directions.

Conventional methods of carrying large-sized electronic parts with leads and other electronic parts generally utilize a so called paper tape or tray. More particularly, a paper tape is a tape-like carrier made of paper where recesses are formed in line for containing parts therein, and a tray is a carrier made of a synthetic resin so as to provide a plurality of recesses for containg parts therein. These recesses are formed through injection molding or vacuum or low pressure forming methods.

In the aforesaid prior art, since the depth of each recess is greater than the height of an IC chip to be placed in the recess, the chip is apt to vibrate during carrying. As a result of such vibration or movement within each recess or casing, the chip leads are apt to be damaged or deformed by receiving undesirable stress or shock.

Damaged or deformed comb-like leads sometimes provide undesirable phenomena such as poor contact or short circuiting, lowering the reliability of the product. Therefore, it has hitherto been necessary to add a process of rearranging of the teeth or pins of deformed leads using a rearranger so that the pitch of the teeth is uniform.

As described in the above, according to conventional chip carrier technology, the chip leads are apt to suffer from deformation and therefore such deformation is a reason for increasing cost because the deformed leads have to be rearranged by an additional process while such deformation sometimes deteriorates the product quality.

In addition, when chips in the carrier are moved when keeping in storage or the like, not only the leads but also the chip proper is apt to be damaged due to vibrations of the chip within the recess or casing of the conventional carrier.

SUMMARY OF THE INVENTION

The present invention has been developed in order to remove the above-described drawbacks inherent to the conventional electronic parts carrier.

It is, therefore, an object of the present invention to provide a new and useful electronic parts carrier with which electronic parts contained in the carrier are prevented from receiving undesirable stresses even if vibrations and/or stresses are applied to the carrier during movement or parts storage.

According to a feature of the present invention an electronic parts carrier having a bottom tape and a top tape are provided where the bottom tape has a plurality of recesses for receiving electronic parts therein, and the top tape is arranged to be secured to the bottom tape such that each electronic part is held and sandwiched between the top and bottom tapes. Since the contained electronic part is secured and prevented from moving within the recess, the comb-like pins of the part are prevented from receiving direct stress. As a result, the pins are difficult to deform, contributing to the maintenance of high quality and cost reduction.

In accordance with the present invention there is provided an electronic parts chip carrier for use with a chip-mounting machine, comprising: a bottom tape having a plurality of recesses for receiving electronic parts chips respectively, each of the recesses having a bottom and side walls; a top tape securable to the bottom tape so as to close upward facing openings of the recesses, respectively; and means for securing the top tape at a predetermined position so that each electronic parts chip received in each of the recesses is securely held and sandwiched between an upper surface of the bottom of the recess and a lower surface of the top tape.

In accordance with the present invention there is also provided an electronic parts chip carrier for use with a chip-mounting machine, comprising: a bottom tape having a plurality of recesses for receiving electronic parts chips respectively, each of the recesses having a bottom and side walls, the depth of each of the recesses being less than the thickness of an electronic parts chip to be received in the recess; a top tape securable to the bottom tape so as to close openings of the recesses; and means for securing the top tape at a predetermined position so that each electronic parts chip received in each of the recesses is securely held and sandwiched between an upper surface of the bottom of the recess and a lower surface of the top tape.

In accordance with the present invention there is further provided an electronic parts chip carrier for use with a chip-mounting machine, comprising: a bottom tape having a plurality of recesses for receiving electronic parts chips respectively, each of the recesses having a bottom and side walls, a first engaging portion being formed on the side walls of each of the recesses; and a top tape securable to the bottom tape so as to close openings of the recesses, the top tape having a plurality of portions each having a second engaging portion to be engaged with the first engaging portion of the side walls so as to secure the top tape, thereby each electronic parts chip received in each of the recesses is securely held and sandwiched between an upper surface of the bottom of the recess and a lower surface of the top tape.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
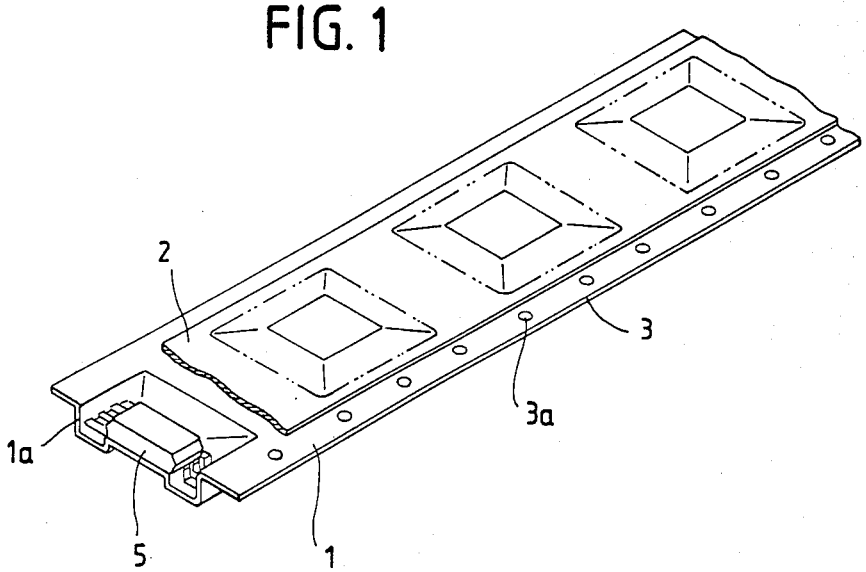
FIG. 1 is a perspective view of an embodiment of the electronic parts carrier according to the present invention.
Figure 2:
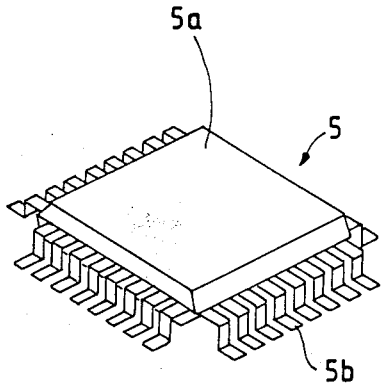
FIG. 2 is a perspective view of an electronic parts chip to be contained in the carrier of FIG. 1.

Referring now to FIG. 1, a schematic perspective view of an embodiment of the electronic parts carrier according to the present invention is shown. In FIG. 1, the reference 1 indicates a bottom tape in which a plurality of recesses 1*a* are formed in line in the longitudinal direction thereof. The bottom tape 1 is made of a film or sheet of polypropylene, polystyrene, ABS resin, polyvinyl chloride or the like. One of these materials may be used alone or added with an additive so that a conductive film or sheet is provided. The reference 2 indicates a top tape having a film base made of polyester, and a heat-sealable adhesive layer. The electronic parts carrier is formed of the above-mentioned bottom tape 1 and top tape 2. The reference 5 is an electronic parts chip shown to be contained in a recess 1*a* of the bottom tape 1. FIG. 2 shows an example of such a chip 5 having a body 5*a* and four sets of comb-like leads 5*b*. The top tape 2 is adhered to the bottom tape 1 at a flange portion 3 (see a cross-sectional view of FIG. 3) of the latter so that the electronic parts chip 5 is held and sandwiched between the lower surface of the top tape 2 and the inner bottom of the recess 1*a* of the bottom tape 1.

The use of a conductive film or sheet for the bottom tape 1 is advantageous because undesirable influence by static electricity on the contained chips 5 is removed. A plurality of pilot holes 3*a* are formed at one flange portion 3 such that the pilot holes 3*a* are equidistantly arranged in line. These pilot holes 3*a* will be used for driving and moving the carrier by an unshown mounting machine at a given pitch.

Figure 3:
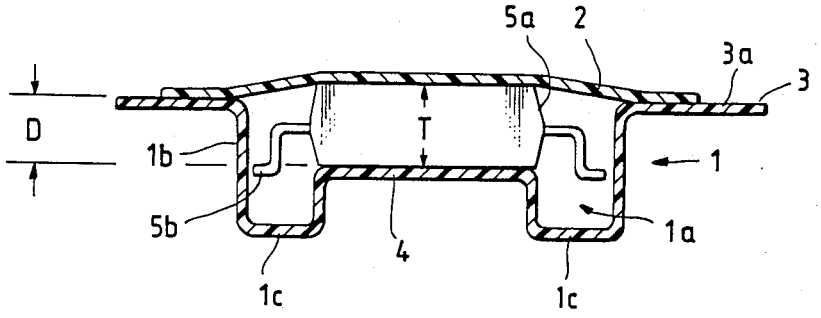
FIG. 3 is a cross-sectional view of the electronic parts carrier shown in FIG. 1.

As best seen in FIG. 3, the recess 1*a* is formed with side walls 1*b*, deep bottom portions 1*c* and a center base 4 peripherally surrounded by the deep bottom portions 1*c*. The height of the center base 4 is selected such that the distance D between the inner surface of the center base 4 and the upper surface of the flange portion 3 is a slightly smaller than the thickness T of the electronic parts chip 5 to be received in the recess 1*a*. With this arrangement, when the top tape 2 is adhered to the flange portion 3 of the bottom tape 1 with the chip 5 being received in the recess 1*a*, the chip 5 is securely held and supported between the center base 4 and the lower surface of the top tape 2. In addition, the deep bottom portions 1*c* are deeper than the center base 4 to provide sufficient room for the leads 5*b* of the chip 5. Therefore, the leads 5*b* are prevented from receiving stresses and vibrations directly because the leads 5*b* are kept in space defined by the side walls 1*b*, the deep bottom portions 1*c* and the top tape 2.

Figure 4:
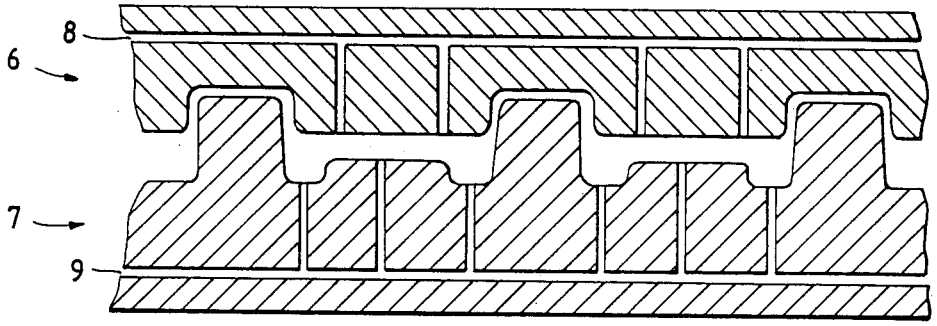
FIG. 4 is a cross-sectional view showing partially a forming mold used for obtaining the electronic parts carrier of FIGS. 1 and 3.

FIG. 4 shows a cross-sectional view of a part of a mold used for forming and molding the bottom tape 1. The mold comprises an upper mold 6 and a lower mold 7 which are arranged to be engaged with each other for forming the bottom tape 1 therebetween. Air supply grooves 8 are formed in the upper mold 6. These air supply grooves 8 are used for taking out a molded product, i.e. a formed bottom tape 1, by way of air pressure. Vacuum grooves 9 are formed in the lower mold 7. These vacuum grooves 9 are used for forming a plastic film which has been heated to a temperature at which thermoplastic molding is possible. More particularly, an unshown vacuum pump is coupled with the vacuum grooves 9 to reduce the pressure of air in recesses of the lower mold 7 so as to shape a heated film supplied to obtain a desired shape according to so called vacuum forming.

In order to carry electronic parts chips 5, each chip 5 is inserted in each recess 1*a* of the bottom tape 1. After electronic parts chips 5 are inserted in the recesses 1*a*, the top tape 2 is adhered to the flange portion 3 of the bottom tape 1 by applying heat of a temperature between 130° C. and 200° C. Each electronic parts chip 5 is sandwiched between the top tape 2 and the center base 4 of the recess 1*a* such that the chip 5 is prevented from moving within the recess 1*a*.

Experiments have been made to see the advantage of the carrier according to the present invention as follows. As the electronic parts chips to be contained in the carrier are used the chips of flat package type as shown in FIG. 2. Each chip 5 has four sets of leads 5*b* each extending in four different directions around the periphery of the chip 5. The above-described carrier is used to carry a plurality of the chips 5, and the carrier is subjected to vibration test whose details are:

Vibration frequency: 10 to 55 Hz;
Method of Sweep: logarithmic sweep
Amplitude: 1.5 millimeters;
Duration: 6 hours with 1 minute cycle;
Directions: Horizontal and vertical with respect to the combs.

TABLE 1

| | PERCENTAGE OF OCCURRENCE OF COMB DEFORMATION |
|---|---|
| FIRST EMBODIMENT | 0% |
| CONVENTIONAL TRAY CARRIER | 3% |

Figure 5:
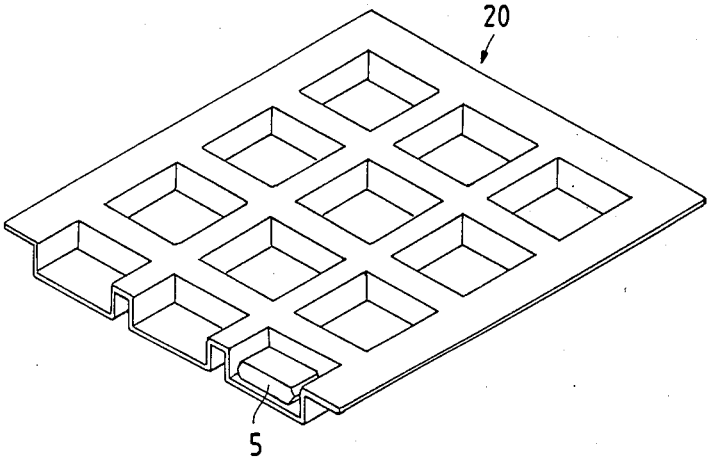
FIG. 5 PRIOR ART
FIG. 5 is a perspective view showing partially a conventional electronic parts carrier of tray type.

In the above, "CONVENTIONAL TRAY CARRIER" means the carrier 20 shown in FIG. 5 of tray type, which has hitherto been widely used for carrying electronic parts chips. The experiments have been made using the above-described first embodiment carrier and the conventional tray carrier under the same conditions mentioned in the above to compare the percentage of comb deformation.

Figure 6:
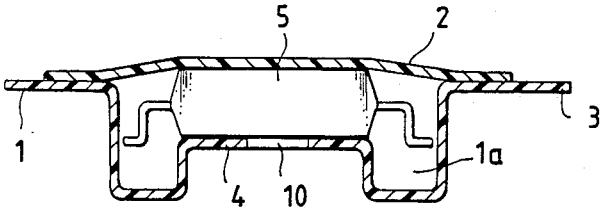
FIG. 6 is a cross-sectional view of a second embodiment electronic parts carrier according to the present invention.

FIG. 6 shows a second embodiment carrier according to the present invention. This second embodiment differs from the above-described first embodiment in that a through-hole 10 is made in the center base 4 at its substantial center. This through-hole 10 is used for recognizing the sort and the presence of the contained chip and also for pushing up the chip 5.

Figure 7:
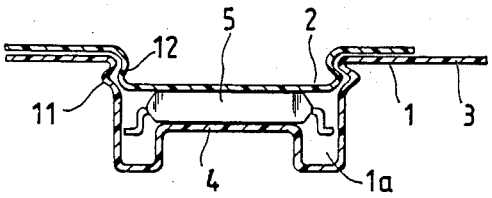
FIG. 7 is a cross-sectional view of a third embodiment electronic parts carrier according to the present invention.

FIG. 7 shows a third embodiment carrier which is different from the above-described first and second embodiments in connection with the way of fixing the top tape 2. More specifically, a groove 11 is made in the side walls 1*b* of the recess 1*a*, and the top tape 2 is shaped so that a portion of the top tape 2 is fitted with the groove 11. In detail, projection or convex portion 12 is provided in the top tape 2 so that the convex portion 12 is engaged with the groove 11 or concave portion. The position of the groove 11 is so arranged that the chip 5 is securely sandwiched between the lower surface of the top tape 2 and the center base 4 of the recess 1*a*.

Experiments have been made in connection with the above-described second and third embodiments under the same condition described in connection with the experiments made in connection with the first embodiment carrier. As a result of vibration test, the percentages of the deformation of combs of the carried chips are shown below.

TABLE 2

| | PERCENTAGE OF OCCURRENCE OF COMB DEFORMATION |
|---|---|
| SECOND EMBODIMENT | 0% |
| THIRD EMBODIMENT | 0% |

The above-described third embodiment has a particular feature that the top tape 2 can be reapeatedly used although the top tape 2 of the first and second embodiments cannot be used repeatedly. This is because no adhesive is used for attaching the top tape 2 to the bottom tape 1 in the third embodiment, and the top tape 2 is detachably secured by way of the concave portion or groove 11 and the convex portion or projection 12 of the molded bodies or members, i.e. the bottom tape 1 and the top tape 2. These convex and concave portions 12 and 11 function as engaging portions to be engaged with each other when the top tape 2 is pressed toward the bottom tape 1. Since the top tape 2 can be attached to the bottom tape 1 repeatedly, the entire carrier can also be used a plurality of times repeatedly. Therefore, substantial cost of the carrier per unit amount of electronic parts chips is remarkably low. Furthermore, since no adhesive is required in the third embodiment, the process of applying an adhesive is unnecessary. Moreover, the top tape 2 can be reattached to the bottom tape 1 when some of the chips carried in the carrier are to be unused after the top tape 2 is detached from the bottom tape 1.

The above-described embodiments are just examples of the present invention, and therefore, it will be apparent for those skilled in the art that many modifications and variations may be made without departing from the scope of the present invention.

What is claimed is:

1. An electronic parts chip carrier for use with a chip-mounting machine, comprising:

(a) a bottom tape having a plurality of recesses for receiving electronic parts chips respectively, each of said recesses having a bottom and side walls, each recess having a top opening;

(b) a flexible top tape securable to said bottom tape so as to close said openings of said recesses; and (c) means for securing said top tape at a predetermined position so that each electronic parts chip received in each of said recesses is securely held and sandwiched between an upper surface of said bottom of each said recess and a lower surface of said top tape using tension of said top tape.

2. An electronic parts chip carrier as claimed in claim 1, wherein said bottom of each recess comprises a center base for placement of a said electronic parts chip thereon, and a peripheral bottom portion surrounding said center base for providing spaces for leads of said electronic parts chip, said peripheral bottom portion having a recess depth greater than a recess depth of said center base.

3. An electronic parts chip carrier as claimed in claim 1, wherein a through-hole is made in said bottom of said recess.

4. An electronic parts chip carrier as claimed in claim 1, wherein said bottom tape is made of a material having electrical conductivity.

5. An electronic parts chip carrier as claimed in claim 1, wherein said securing means comprises grooves made in side walls of said recess and convex portions of said top tape, said convex portions being arranged to be engageable with said grooves so that said top tape is secured to said bottom tape sandwiching said electronic parts chip between said top tape and said bottom of said recess.

6. An electronic parts chip carrier for use with a chip-mounting machine, comprising:

(a) a bottom tape having a plurality of recesses for receiving electronic parts chips respectively, each of said recesses having a bottom and side walls and a top opening, the depth of each of said recesses being less than the thickness of an electronic parts chip to be received in the recess;

(b) a flexible top tape securable to said bottom tape so as to close said openings of said recesses; and (c) means for securing said top tape at a predetermined position so that each electronic parts chip received in each of said recesses is securely held and sandwiched between an upper surface of said bottom of each said recess and a lower surface of said top tape using tension of said top tape.

7. An electronic parts chip carrier as claimed in claim 6, wherein said bottom of each recess comprises a center base for placement of a said electronic parts chip thereon, and a peripheral bottom portion surrounding said center base for providing spaces for leads of said electronic parts chip, said peripheral bottom portion having a recess depth greater than a recess depth of said center base.

8. An electronic parts chip carrier as claimed in claim 6, wherein a through-hole is made in the bottom of each said recess.

9. An electronic parts chip carrier as claimed in claim 6, wherein said bottom tape is made of a material having electrical conductivity.

10. An electronic parts chip carrier as claimed in claim 6, wherein said securing means comprises a heat-sealable adhesive layer provided on a lower surface of said top tape.

11. An electronic parts chip carrier for use with a chip-mounting machine, comprising:

(a) a bottom tape having a plurality of recesses for receiving electronic parts chips respectively, each of said recesses having a bottom and side walls and a top opening, a first engaging portion being formed on said side walls of each of said recesses; and (b) a flexible top tape securable to said bottom tape so as to close said openings of said recesses, said top tape having a plurality of portions each having a second engaging portion to be engaged with said first engaging portion of said side walls so as to secure said top tape, thereby each electronic parts chip received in each of said recesses is securely held and sandwiched between an upper surface of said bottom of said recess and a lower surface of said top tape using tension of said top tape.

12. An electronic parts chip carrier as claimed in claim 11, wherein said bottom of said recess comprises a center base for placement of a said electronic parts chip thereon, and a peripheral bottom portion surrounding said center base and of greater depth than said base for providing spaces for leads of said electronic parts chip.

13. An electronic parts chip carrier as claimed in claim 11, wherein a through-hole is made in said bottom of said recess.

14. An electronic parts chip carrier as claimed in claim 11, wherein said bottom tape is made of a material having electrical conductivity.

15. An electronic parts chip carrier as claimed in claim 11, wherein said first engaging portion comprises a groove portion made in said side walls of said recess, and said second engaging portion comprises a convex portion made by said top tape to be fitted with said groove portion.

* * * * *